US006536049B2

(12) United States Patent
Jastrab et al.

(10) Patent No.: US 6,536,049 B2
(45) Date of Patent: Mar. 25, 2003

(54) WINGED COSTUME ATTACHMENTS

(76) Inventors: Marcey Jastrab, 56 N. Main St., Keedysville, MD (US) 21756; Scott W. Reeves, 56 N. Main St., Keedysville, MD (US) 21756

( * ) Notice: Subject to any disclaimer, the term of this patent is extended or adjusted under 35 U.S.C. 154(b) by 0 days.

(21) Appl. No.: 09/736,153

(22) Filed: Dec. 15, 2000

(65) Prior Publication Data

US 2002/0073476 A1 Jun. 20, 2002

(51) Int. Cl.[7] ..... A41D 3/08
(52) U.S. Cl. ..... 2/88; 446/26; 2/69.5
(58) Field of Search ..... 2/88, 160, 249, 2/59, 69.5; 446/26–28

(56) References Cited

U.S. PATENT DOCUMENTS

| | | | | | |
|---|---|---|---|---|---|
| 766,613 | A | * | 8/1904 | Greene | 2/88 |
| D45,010 | S | | 12/1913 | Lanier | |
| 1,324,218 | A | * | 12/1919 | Ward | 2/88 |
| 1,810,556 | A | * | 6/1931 | Fenton | 2/88 |
| 2,213,754 | A | * | 9/1940 | Thirring | 2/88 |
| 2,810,576 | A | * | 10/1957 | Massey | 2/88 |
| 3,013,797 | A | | 12/1961 | Schwartz | |
| 3,657,741 | A | * | 4/1972 | Blanco | 2/59 |
| 3,830,512 | A | * | 8/1974 | Spiegel | 280/11.37 |
| 5,010,589 | A | * | 4/1991 | Hamilton | 2/1 |
| D351,493 | S | | 10/1994 | DeCinque | |
| 6,003,155 | A | | 12/1999 | Silberman | |
| 6,041,436 | A | * | 3/2000 | Keen | 2/69 |
| D422,397 | S | | 4/2000 | Cohen | |
| D433,210 | S | | 11/2000 | Allison | |

OTHER PUBLICATIONS

Butterick Pattern Book, Jan./Feb. 1999, p. 188, Adult's and Child's Angel Costumes with Wings.

Magic Cabin Catalog (undated), p. 18, "Silk Wings," Item No. 60009.

* cited by examiner

*Primary Examiner*—John Calvert
*Assistant Examiner*—Katherine Moran
(74) *Attorney, Agent, or Firm*—Richard C. Litman

(57) ABSTRACT

Winged costume attachments provide for the quick and easy donning and removal of costume wings, as worn for various costume parties or gatherings, stage plays, etc. The attachments comprise left and right shoulder and wrist straps, with each strap preferably formed of an elastic material covered with a protective fabric sleeve. Reinforcements are provided at each wingtip for secure attachment of the wrist straps, and an additional central reinforcement panel is provided for secure attachment of the shoulder straps. The central reinforcement panel may comprise a specific panel provided only for reinforcement, or may comprise a portion of an additional panel extending from the wing panels to form a tail or other component. The present attachment strap configuration results in the neck and chest areas of the wearer remaining clear of any attachment straps, thereby providing a safer costume which is easily donned and removed by small children without assistance.

15 Claims, 7 Drawing Sheets

WINGED COSTUME ATTACHMENTS

BACKGROUND OF THE INVENTION

1. Field of the Invention

The present invention relates generally to costume apparel, and more specifically to attachment means for costumes simulating wings or similar devices of various configurations. The present attachments essentially comprise a single shoulder strap and wrist band of elastic material, on each wing panel. The present costume wings are thus devoid of any straps or the like extending about the neck or across the chest, thereby providing a significant advance in safety and ease of donning and removal, particularly for younger persons.

2. Description of the Related Art

Humankind has been inspired by the concept of flight for thousands of years, as evidenced by ancient myths, legends, and artwork. Only relatively recently has technology advanced sufficiently to permit human flight, with the technology involving relatively high complexity and costs, as well as requiring significant training.

Nevertheless, flight remains a dream for many people, particularly younger children in their games and activities. Actual flight is of course beyond a realistic possibility in casual children's play, but nearly all children nevertheless enjoy fantasizing or imagining flight at times in their play.

Accordingly, costume wings have been developed for use in children's play activities, as well as for use in adult activities such as costume parties, stage plays and dances, etc. Such wings per se are well known and old in the art, and have been developed in a vast number of different configurations in order to simulate virtually every known type of flying bird and insect, as well as innumerable mythical creatures.

These various costume wing configurations are installed upon the wearer in various ways, almost always involving a series of inelastic straps, ties, or cords or the like. The object of these attachment means is nearly always to provide a very secure and positive means of securing the relatively large costume wing panels to the body of the wearer. While a series of straps or the like passing from each shoulder and around the throat or front of the neck and across the torso and around the waist generally provides the attachment security desired, they are not a desirable means of securing relatively small costume wing panels to children for casual play activity. The most important drawback to such multiple and cumbersome strap attachments, is the passage of straps or ties close to the throat or neck of the wearer. The potential hazard among small children at play, and even among adults wearing relatively large and cumbersome costumes, is apparent. Also, most children take pride in being able to accomplish various tasks on their own, without adult assistance. The various earlier developed means of securing costume wings upon the body, nearly always require the assistance of another person. This is true even for adults donning such costume wings, in many cases.

Accordingly, a need will be seen for a safer and more straightforward means of securing such costume wings to the wearer, with the attachment means avoiding any potential choking hazard for the wearer and also enabling the wearer of the costume wings to don the wings himself or herself, without additional assistance. The present winged costume attachments are preferably formed of an elastic material to provide some "give" and stretch, both to enable the wearer to don and remove the wings easily, and also to avoid injury to the wearer in the event one of the wing panels becomes caught upon another object during play or other activity.

A discussion of the related art of which the present inventors are aware, and its differences and distinctions from the present invention, is provided below.

U.S. Pat. No. 3,013,797 issued on Dec. 19, 1961 to Grace Schwartz, titled "Accoutrement For Choreography," describes a wing costume assembly having a single wing panel extending from tip to tip and completely across the wearer's back. Extension poles are provided to extend the span of the wings, with the poles seating in sockets secured to the wrists of the wearer. The wrist attachments are not permanently secured to the wing panel, but rather serve as seats for the extension poles which in turn insert into elongate pockets along the leading edge of each side of the wing panel, along with the arms of the wearer. The Schwartz costume also has a neck opening (column 4, line 39), through which the wearer must pass his/her head and neck to don the costume. In contrast, the wrist attachments of the present wing costume embodiments are permanently secured to the outer tip areas of the wing panels, rather than merely serving as attachment points for fittings which in turn secure to the wing panel. Also, the present wing costume has no material surrounding the neck and defining a neck opening. The sole means of securing the present panels to the body of the user, comprises a single elastic shoulder strap and a single elastic wrist strap extending from each wing panel.

U.S. Pat. No. 6,003,155 issued on Dec. 21, 1999 to Regina Silberman, titled "Security Garment," describes an article more closely resembling a conventional poncho, than a wing costume. The front and back panels of the Silberman article extend completely across the wearer from wrist to wrist and are secured together, which does not allow them to streamline rearwardly in the breeze when running, as is desired for a set of costume wings. The Silberman garment includes a neck opening but has no wrist attachments, whereas the present wing costume has an open neck area with separate shoulder and wrist attachments.

U.S. Pat. No. D-45,010 issued on Dec. 9, 1913 to May F. Lanier, titled "Ceremonial Gown," illustrates a design comprising a robe or gown with a generally triangular panel extending between each sleeve and the respective side of the body of the gown. The triangular panels are apparently a permanent part of the gown; thus, no separate attachment means is apparent for the panels. No gown, robe, or other garment for covering the trunk of the body, is provided by the present winged costume attachment invention.

U.S. Pat. No. D-351,493 issued on Oct. 18, 1994 to Diane C. DeCinque, titled "Winged Applique For A Shirt," illustrates a design wherein a pair of winglike panels are sewn to a conventional shirt, extending from the end of each arm and down the respective side of the shirt. The result more closely resembles the Lanier '010 design discussed immediately above, than the present winged costume attachments invention, with its removable shoulder and wrist securing straps.

U.S. Pat. No. D-422,397 issued on Apr. 11, 2000 to Steve N. Cohen, titled "Pair Of Sleeves With Attached Display Flag," illustrates various embodiments of a design essentially as described by the title of the patent. The sleeves are completely independent of one another, with the only means of securing the devices to the arms of the wearer being the tubular configuration of the sleeves themselves. No means of securing a single, continuous costume wing panel across the back and arms of a person is provided by the Cohen disclosure.

U.S. Pat. No. D-433,210 issued on Nov. 7, 2000 to Ian T. Allison, titled "Bat Costume," illustrates a design as described by the title of the patent. While a costume design is claimed, no means is apparent for securing the design to the body of a person. More specifically, no shoulder or wrist strap attachments are shown in the Allison '210 Design Patent. Moreover, it appears that the device would have to be worn across the front of the wearer due to the thickness of the central area between the winged extensions, rather than across the back, as in the present winged costume attachments invention.

Page 188 of the Butterick clothing patterns catalog of January and February 1999 illustrates both an adult and child's angel costume with wings extending from the shoulder areas of each costume. As only the front view is shown of each costume, the specific attachment of the wings is not clear. However, a series of straps or ties is shown extending around the waist and diagonally across the chest, with the arms remaining completely clear of the relatively rigid wings. The present winged costume attachments utilize only shoulder and wrist strap attachments for wings formed of a single ply of a lightweight, soft, and flexible fabric, unlike the relatively rigid and built up wing structures illustrated in the Butterick catalog reference.

Finally, page 18 of an undated catalog from Magic Cabin Co. illustrates front and back views of "Silk Wings" being worn by two children. While the Magic Cabin wings include wrist straps, the central attachment ties are relatively complex, cumbersome, and potentially hazardous, with their wraps about the sides of the neck and diagonally across the chest and additional waist ties with their long, trailing extensions. Also, no reinforcement means is apparent in the Magic Cabin disclosure, which is essential for the relatively lightweight fabric used in the present winged costume.

In addition to the above specific patents and other disclosures, the present inventors are well aware of the use of shoulder straps for use in carrying back packs, book bags, luggage, and other relatively heavy and bulky articles on the back. However, to the best of the inventors' knowledge, all such devices have been equipped with relatively stout, non-elastic shoulder straps. The use of elastic in the construction of a shoulder strap in a device intended for carrying relatively heavy loads, is clearly impracticable. Such back pack, luggage, etc. shoulder straps clearly teach away from the use of a stretchable elastic material, whereas a non-elastic material is not desirable in the present invention, due to the desire to retain simplicity and avoid the need for complex and awkward buckles or other devices to secure the straps. Using elastic bands for the wrist and shoulder straps of the present invention, anyone, including relatively small children, may quickly and easily don and remove a winged costume without need for assistance by others, thereby greatly increasing their independence. The elastic wrist and shoulder strap means of the present invention provides a significant advance in safety as well, as such straps will "give" to allow the wearer's arm to pull free in the event the wing is caught upon some object. A nonelastic strap cannot provide such a safety advantage.

None of the above inventions, patents, and devices, taken either singularly or in combination, is seen to describe the instant invention as claimed.

SUMMARY OF THE INVENTION

The present invention comprises means for temporarily and removably securing or attaching various winged costume embodiments to the upper body of a person (child or adult). The present attachment system overcomes various problems or disadvantages of attachment means for such costume devices developed in the past, by providing a single wrist strap and a single shoulder strap to each side of the single continuous wing panel which extends essentially across the arm span from hand to hand. The attachment straps of the present winged costumes are elastic, with the elastic material preferably encased in a fabric sleeve for durability and appearance. Reinforcement areas are provided for each wrist strap attachment point, with additional reinforcement provided for the shoulder strap attachment area. The generally central shoulder strap attachment area reinforcement may comprise one or more additional panels attached to that area, or may comprise additional material forming a tail or other components, attached to the central area of the wing panels. The material from which the wings are formed is preferably a lightweight natural fabric of some sort, but may comprise any natural or synthetic, woven or nonwoven sheet material as desired.

Accordingly, it is a principal object of the invention to provide various embodiments of winged costumes and attachments therefor, with the attachments comprising left and right shoulder and wrist bands or straps extending from the wing panels with the neck, chest, and waist areas being devoid of any attachment means.

It is another object of the invention to provide winged costumes and attachments therefor, which attachments comprise elastic straps having fabric sleeves disposed thereover.

It is a further object of the invention to provide winged costumes and attachments therefor, including reinforcement panels disposed at each strap attachment point.

Still another object of the invention is to provide winged costumes and attachments therefor, which central reinforcement panel may comprise an additional sheet of material forming an extension component (e.g., tail, etc.) for the wing panels.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention describes winged costume attachments for conveniently securing and easily removing costume articles, such as simulated wing panels, upon a wearer. The winged costume attachments of the present invention may be applied to innumerable variations and patterns of such simulated wings, with but a few of the possible variations being shown in the accompanying drawings. It will be understood that the basic concept of the present invention is adaptable to far more variations and embodiments than those illustrated, however. The present invention also includes various wing panel embodiments in combination with the attachment means, as well.

Figure 1:
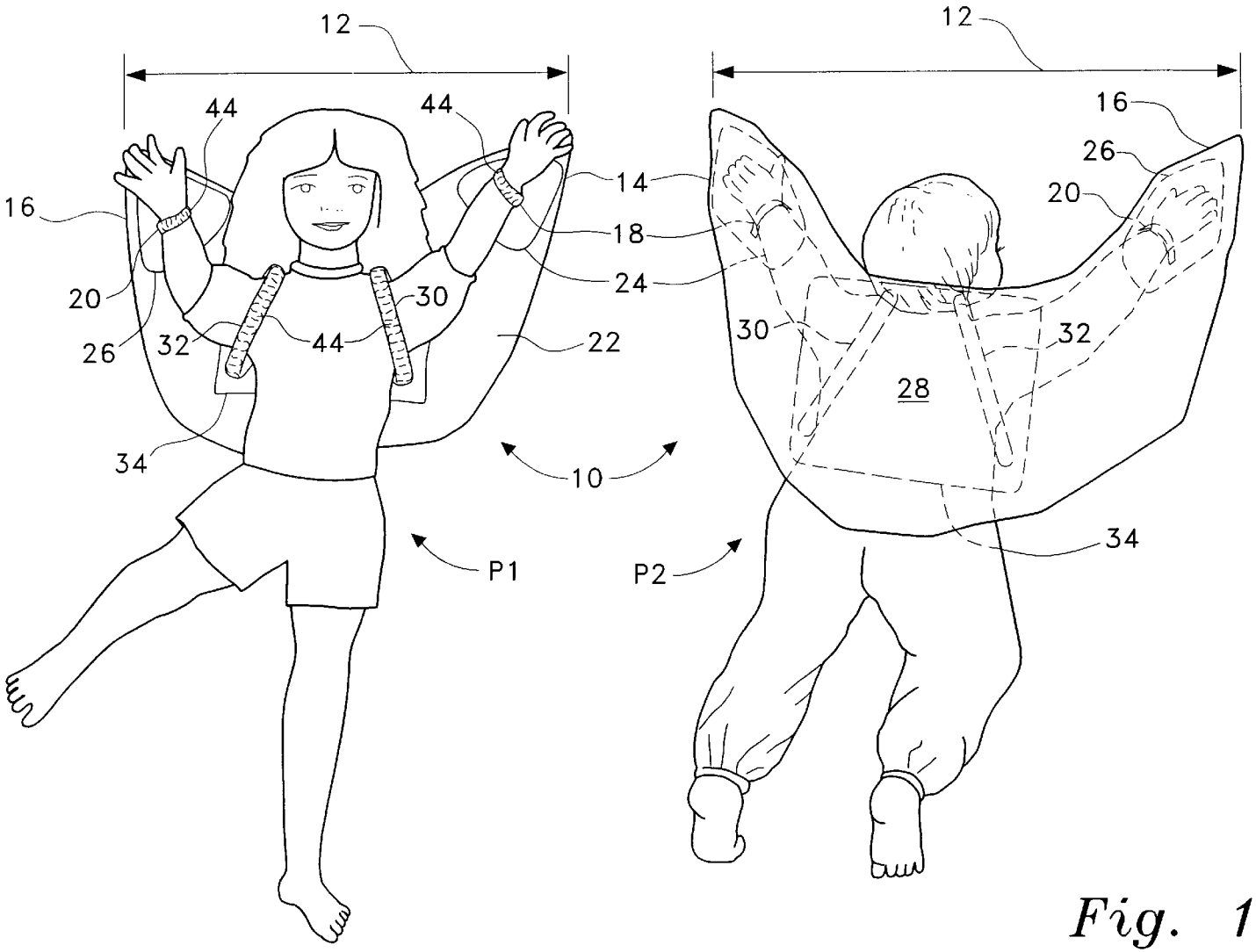
FIG. 1 provides front and rear environmental, perspective views of a first embodiment of the winged costume and attachments of the present invention.
Figure 2A:
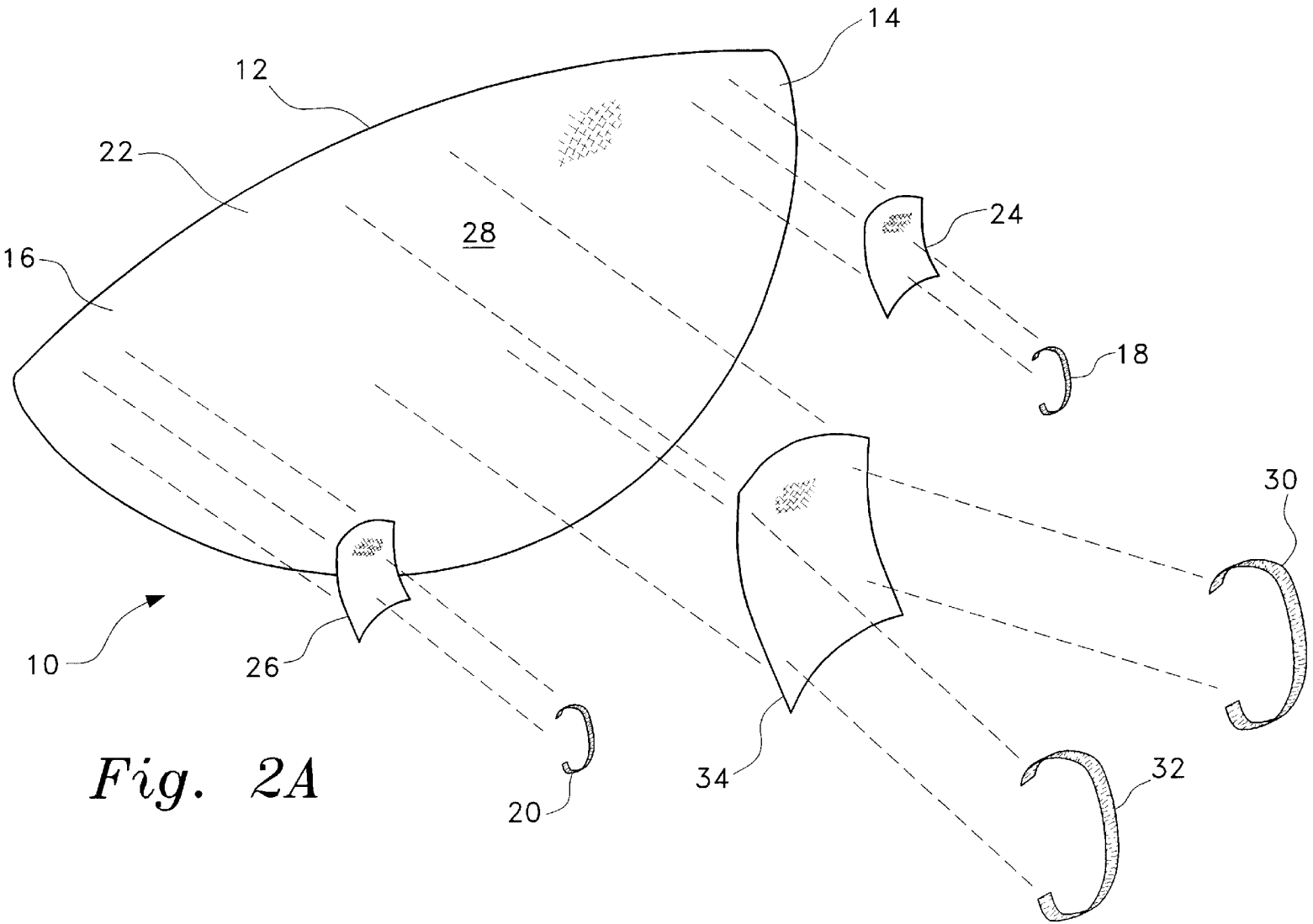
FIG. 2A is an exploded perspective view of the winged costume and attachments of FIG. 1, showing its various components.
Figure 2B:
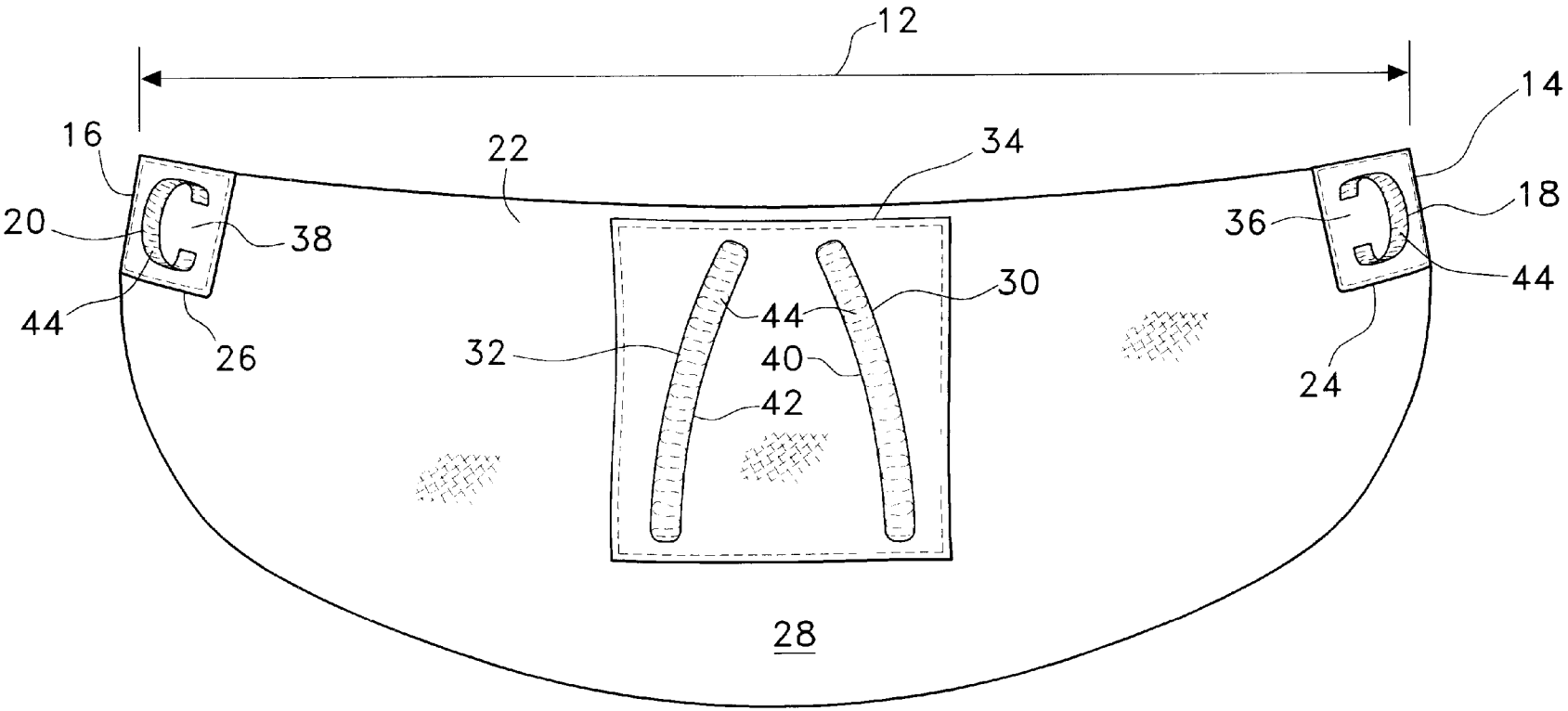
FIG. 2B is a front elevation view of the assembled winged costume and attachments of FIG. 2A.

FIGS. 1 through 2B illustrate various views of a first embodiment wing panel with attachment straps. The wing panel 10 of FIGS. 1 through 2B comprises a single panel having a span 12 extending from a left wing tip area or portion 14 across the back of the wearing person P1 or P2, to a right wing tip area or portion 16. The left and right wing tip areas 14 and 16 respectively include a semicircular left and right wrist attachment strap or band, respectively 18 and 20, extending from the front surface 22 of the wing panel 10. Preferably, a wrist strap reinforcement panel, respectively 24 and 26, is installed (stitched, etc.) to the front surface 22 of the wing panel 10 at each tip area 14 and 16 for durability of the winged costume 10, which is preferably formed of a relatively light weight natural or synthetic woven fabric (silk, a light Nylon, etc.). However, other woven or non-woven materials (e.g., light weight plastic sheet, etc.) may be used to form the wing panel 10 if so desired.

The central area 28 of the wing panel 10 includes a left and a right shoulder strap or band, respectively 30 and 32, extending from the front surface 22 thereof. These shoulder straps 30 and 32 are of the same general configuration as the wrist straps 18 and 20, but are of course somewhat larger in order to fit about the shoulders and/or upper arms of the wearing person P1 or P2. Preferably, a central reinforcement panel 34 is attached (stitched, etc.) to the front surface 22 of the central area 28 of the wing panel 10, to reinforce the strap attachments in the manner of the reinforcements 24 and 26 provided for the wrist strap attachments.

Each of the straps or bands 18, 20, 30, and 32 is preferably formed of an elastic material, in order to provide a secure fit about the wrists and shoulders of a person wearing the present costume wings 10. The use of an elastic material has been found to work well in securing the wings 10 to the body of the person P1, P2 wearing the wings, as the wings are quite light in weight due to the light weight materials from which they are constructed. The use of such light weight materials is primarily to allow the wings 10 to streamline and float in the breeze when the wearer is running, or in any light wind or breeze relative to the wearer. However, the very light weight material provides other advantages, in that it does not require heavy, inelastic attachment straps and accompanying relatively complex buckles, additional straps, etc., as required by many such wing costumes of the prior art. The elastic material works well in securing the light weight wings 10 to a person, and also allows a very young child to don and remove the wings 10 easily by himself or herself without need for additional assistance.

As no buckles or other mechanical fastener or closure means is required with the present elastic bands or straps, they may be formed as continuous closed loops at each point on the wing panel 10. The closed bands 18, 20, 30, and 32 and the respective underlying material to which they are stitched or otherwise attached, i.e., left and right wing tip areas 14 and 16 and central area 28, or the respective reinforcement areas 24, 26, and 34, define a pair of closed wrist passages 36, 38 and closed shoulder passages 40, 42, shown most clearly in FIG. 2B of the drawings. Preferably, each of the elastic straps or bands 18, 20, 30, and 32 is enclosed by a fabric sleeve material 44, as indicated by the gathered external appearance of the straps 18, 20, 30, and 32 in FIGS. 1 through 2B, in order to protect the elastic material.

Figure 3A:
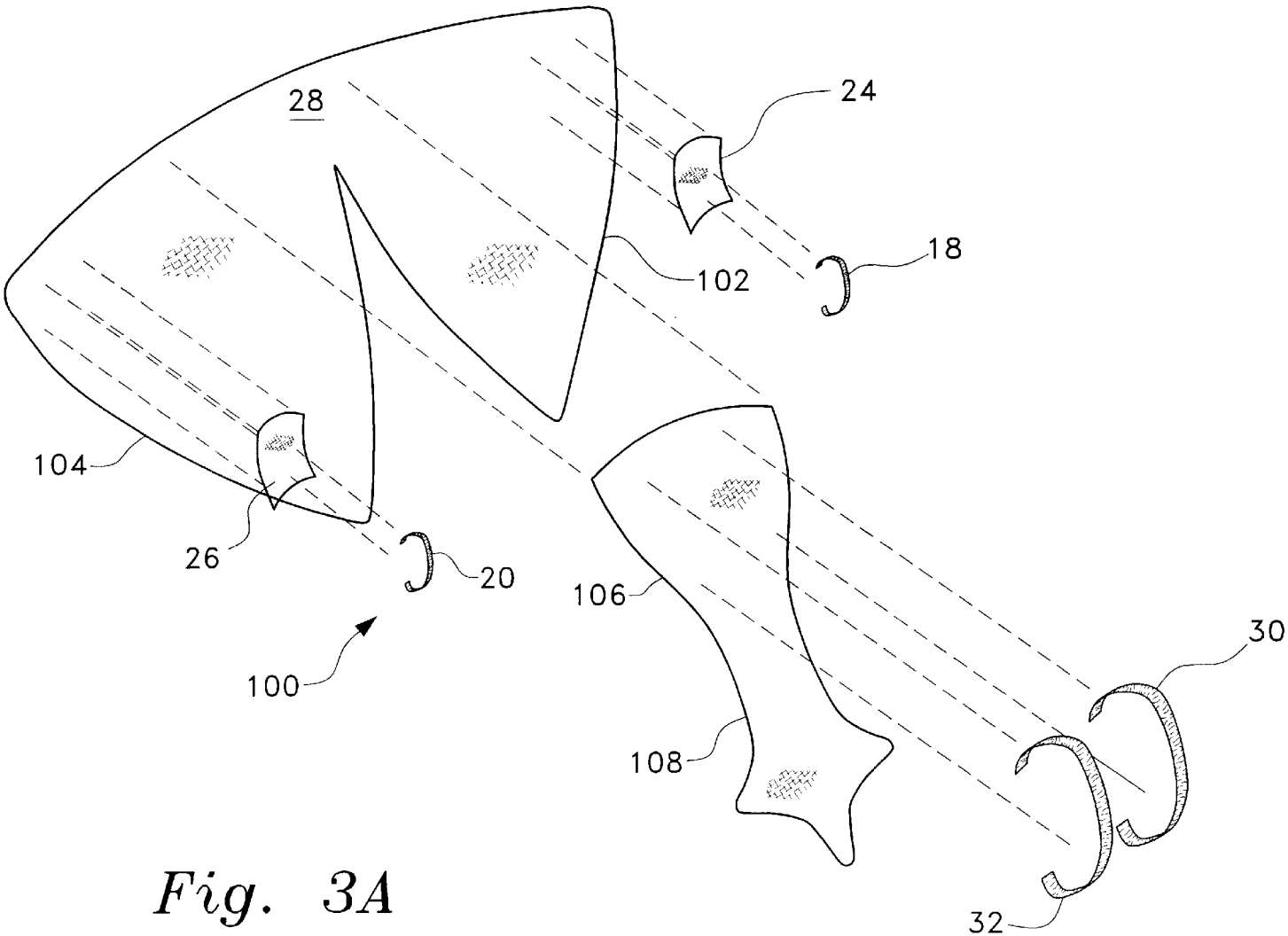
FIG. 3A is an exploded perspective view of an alternative embodiment of the winged costume and attachments, showing the provision of a tail portion also serving as the central reinforcement area.
Figure 3B:
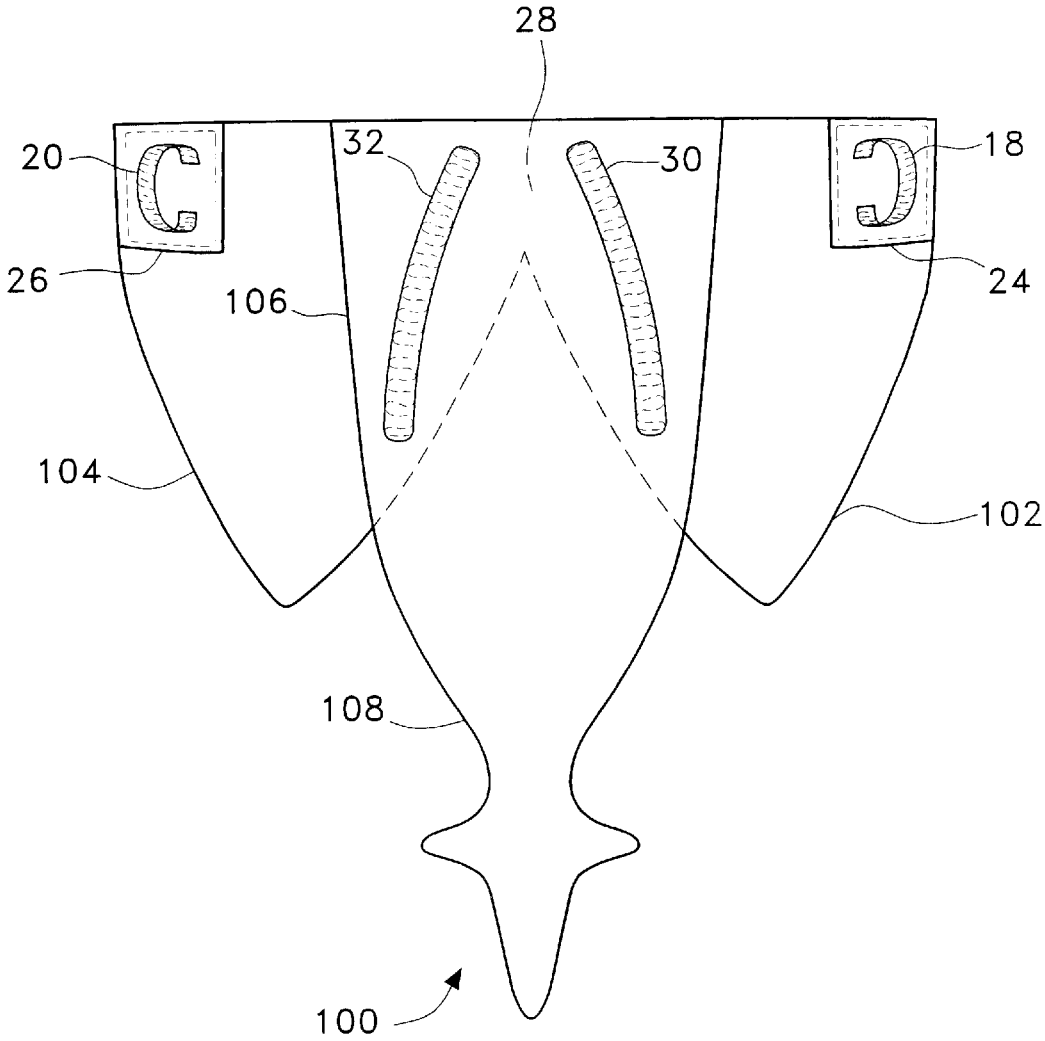
FIG. 3B is a front elevation view of the assembled winged costume and attachments embodiment of FIG. 3A.

FIGS. 3A and 3B respectively provide exploded and assembled front perspective and elevation views of an alternative embodiment wing costume, designated as wing panel 100. The wing panel costume 100 contains essentially the same components as the winged costume 10 of FIGS. 1 through 2B, including left and right wrist straps or bands 18 and 20 with accompanying reinforcements 24 and 26 and left and right shoulder straps or bands 30 and 32. However, the wing panel 100 is configured differently, being divided generally into left and right halves 102 and 104 extending to each side of the central area 28, to represent two separate wings.

The central shoulder strap reinforcement panel 106 also differs from the central reinforcement 34 of the wing costume 100 of FIGS. 1 through 2B, in that the reinforcement panel 106 of the wings 100 comprises an elongate extension, with a downwardly or rearwardly extending tail portion 108. When the elongate extension panel 106 is assembled to the left and right wing panels 102 and 104, the result is somewhat representative of a dragon, with its separate left and right wing panels 102 and 104 and elongate, outwardly or rearwardly extending tail portion 108 formed by the extension of the shoulder strap reinforcement panel 106.

Figure 4:
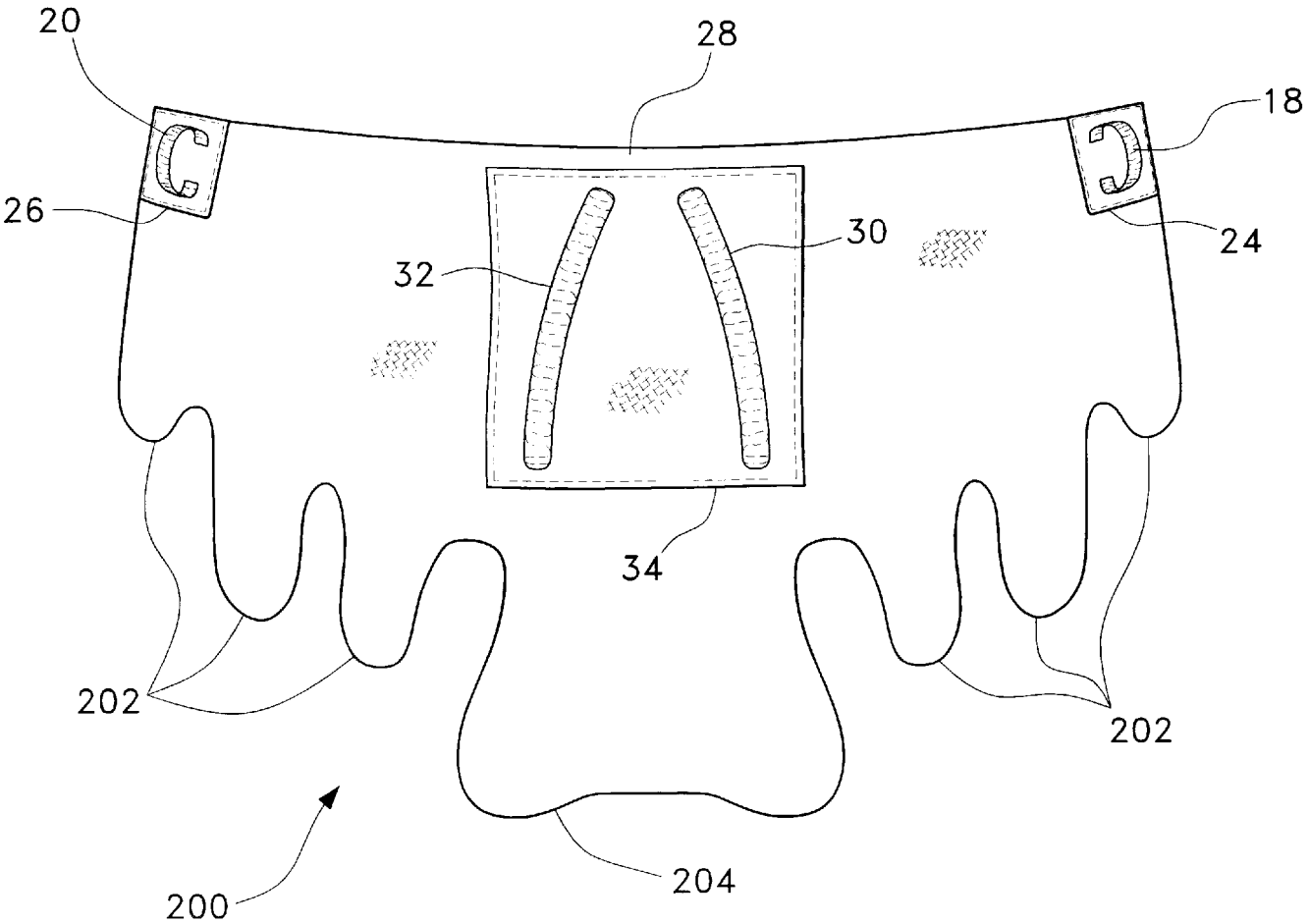
FIG. 4 is a front elevation view of yet another embodiment of the present winged costume and attachments invention.

FIG. 4 provides a front elevation view of yet another embodiment of the present wing costume, having a wing panel 200 with a scalloped or feathered trailing edge 202. This configuration may be colored in some manner to resemble the wings of a bird with their feathered trailing edges, if so desired. The panel 200 is formed of a single sheet of material, but may include a tail extension 204 extending rearwardly from the central area 28 of the wing panel 202, to provide further resemblance to a bird configuration. Alternatively, the central reinforcement panel 34 and tail extension may be formed of a single piece of material and applied to the wing panel 200, if so desired, in the manner of the "dragon tail" configuration of the wing costume panel 100 of FIGS. 3A and 3B. In other respects, the wing costume panel 200 is essentially identical to the wing costume panel 100 of FIGS. 1 through 2B, having an essentially continuous and unbroken span from tip to tip with left and right wrist straps or bands 18 and 20 and their accompanying reinforcements 24 and 26, and left and right shoulder straps 30 and 32 and corresponding central shoulder strap reinforcement 34.

Figure 5:
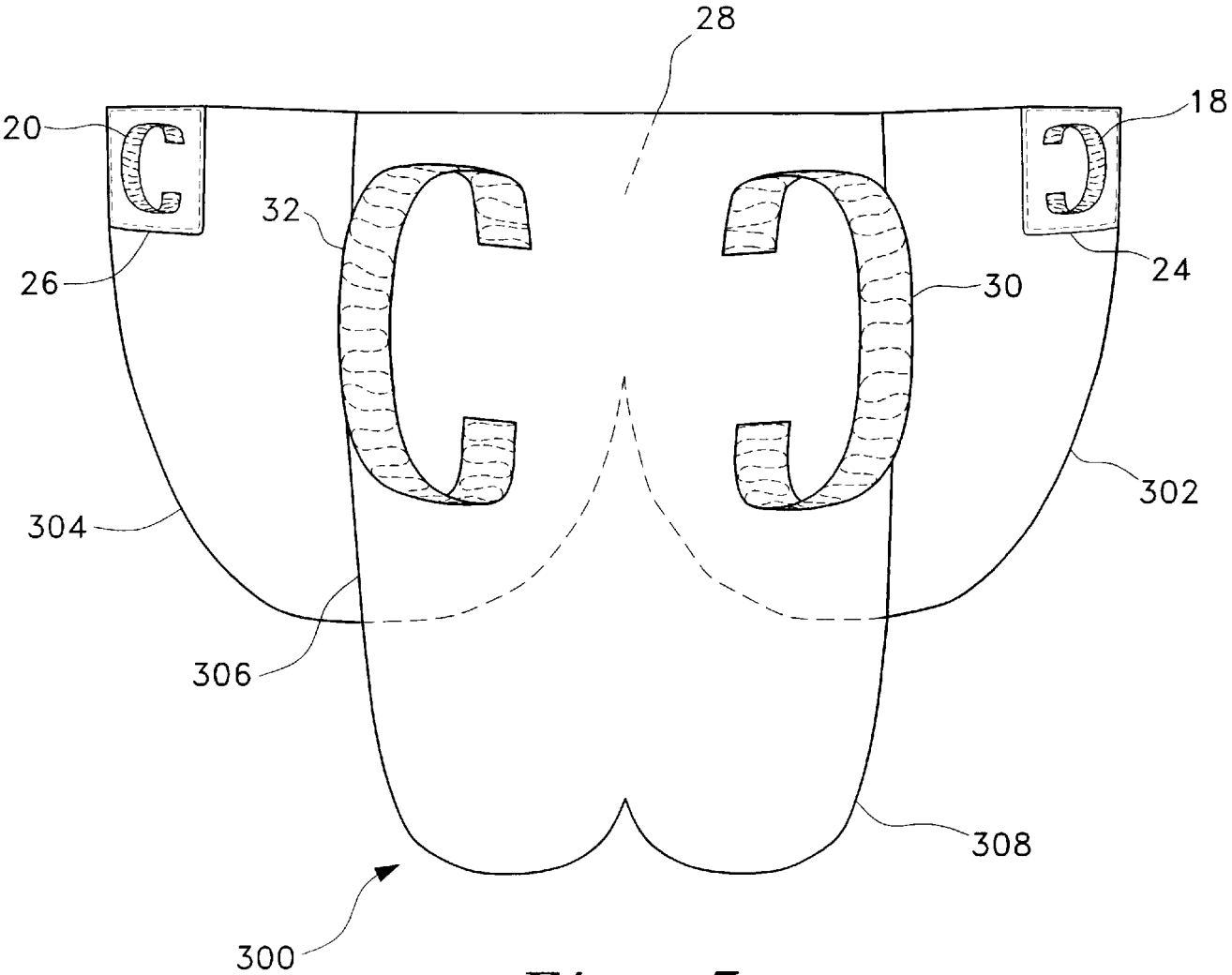
FIG. 5 is a front elevation view of still another embodiment of the present winged costume and attachments invention.

FIG. 5 is a front elevation of a further embodiment of the present invention, similar to the "dragon wing and tail" embodiment of FIGS. 3A and 3B, discussed further above. The wing costume 300 of FIG. 5 includes a left and a right wing panel or lobe, respectively 302 and 304, formed of a single sheet of material. As in the case of other embodiments of the present invention, left and right wrist straps or bands 18 and 20 and corresponding reinforcement panels 24 and 26 are installed at the panel tips, with left and right shoulder straps or bands 30 and 32 secured to the central area 28 of the wing panel 300. The reinforcement 306 also includes an extended tail portion 308, which also comprises two lobes. The result is an appearance resembling many beetles, with their flight wings represented by the two wing panels 302 and 304 and their wing covers represented by the lobed central reinforcement panel 306 and extension 308. As in the case of all of the various embodiments of the present invention, the embodiment of FIG. 5 may be colored as desired, e.g., to resemble a "ladybug," or other insect as desired.

In conclusion, the present winged costume and attachments provides a novel means for fitting such costumes to a person, comprising the use of a series of elastic straps or bands at the wrists and shoulders. The shoulder bands or straps are independent of one another excepting their attachment to a reinforcing panel or panels at the center of the wing panel, thus defining an open area therebetween which is devoid of any other attachments or encumbrances. This provides a significant advance in safety for persons wearing the present wing configurations, as no straps, ties, or other elements pass in front of the neck or throat, across the chest, or around the waist with the present wing costumes. In addition, the elastic nature of the wrist and shoulder straps allows them to stretch in the event that a wearer of the present costume catches some portion of the costume on another object, thus allowing the person to pull free.

The present elastic wrist and shoulder straps also enable a person to don and remove the wings quickly and easily. While this is an advantage for all who may wish to wear such wings, including adults for a costume party, play, etc., it is of particular significance to smaller children, who no longer require the assistance of an adult in donning or removing the costume wings of the present invention. The present elastic wrist and shoulder straps provide a significant advance in comfort for the wearer as well, as they do not bind or restrict a person wearing the wings with the present attachment bands when that person bends, stretches, or otherwise moves.

As the various wing panels and extensions of the present invention are preferably formed of very light weight materials, the elastic bands or straps are quite sufficient to hold them in place upon the wearer of the device. Such lightweight fabric will generally require some reinforcement at the wrist and shoulder strap attachment points, as noted above. It should be noted that these reinforcement areas are not limited to only a single ply of fabric or other sheet material, but may comprise additional sheets of identical or differing dimensions, as required to provide a sound assembly. The result is an attractive, safe, easily donned and removed, yet durable winged costume which will provide hours of enjoyment for wearers of all ages.

It is to be understood that the present invention is not limited to the embodiments described above, but encompasses any and all embodiments within the scope of the following claims.

We claim:

1. Attachment means for temporarily and removably securing a winged costume to a person, with the winged costume comprising a single, continuous wing panel having at least a left wing tip area, a right wing tip area, a span extending thereacross, a central area, and a front surface, said attachment means comprising:

a closed left wrist strap extending from the front surface of the left wing tip area of the wing panel, and a closed right wrist strap extending from the front surface of the right wing tip area;

a closed left shoulder strap extending from the front surface of the central area of the wing panel, and a closed right shoulder strap extending from the front surface of the central area;

each said wrist strap and respective underlying surface to which each said wrist strap is attached defining a closed wrist passage, and each said shoulder strap and respective underlying surface to which each said shoulder strap is attached defining a closed shoulder passage;

at least one reinforcement panel disposed beneath each said strap, for securing each said strap to the respective underlying surface; and each said shoulder strap defining an open passage therebetween, devoid of additional structure.

2. The attachment means according to claim 1, wherein each said strap comprises an elastic band.

3. The attachment means according to claim 1, including a fabric sleeve surrounding each said strap.

4. A winged costume and attachments, comprising:

a single, continuous wing panel having at least left wing tip area, a right wing tip area, a span extending thereacross, a central area, and a front surface;

a closed left wrist strap extending from said front surface of said left wing tip area, and a closed right wrist strap extending from said front surface of said right wing tip area;

a closed left shoulder strap extending from said front surface of said central area, and a closed right shoulder strap extending from said front surface of said central area;

each said wrist strap and respective said surface to which each said wrist strap is attached defining a closed wrist passage, and each said shoulder strap and respective said surface to which each said shoulder strap is attached defining a closed shoulder passage;

at least one wrist strap reinforcement panel disposed between each said wrist strap and respective said wing tip area; and each said strap comprising an elastic band.

5. The winged costume and attachments according to claim 4, including a fabric sleeve surrounding each said strap.

6. The winged costume and attachments according to claim 4, including at least one shoulder strap reinforcement panel disposed between each said shoulder strap and said central area.

7. The winged costume and attachments according to claim 6, wherein said at least one shoulder strap reinforcement panel comprises an extension panel secured to said central area of said wing panel, and extending outwardly therefrom.

8. The winged costume and attachments according to claim 4, wherein said wing panel is formed of materials selected from the group consisting of natural and synthetic lightweight woven fabric materials.

9. The winged costume and attachments according to claim 4, wherein said wing panel is formed of a lightweight sheet of nonwoven material.

10. A winged costume and attachments, comprising:

a single, continuous wing panel having at least a left wing tip area, a right wing tip area, a span extending thereacross, a central area, and a front surface;

a closed left wrist strap extending from said front surface of said left wing tip area, and a closed right wrist strap extending from said front surface of said right wing tip area;

a closed left shoulder strap extending from said front surface of said central area, and a closed right shoulder strap extending from said front surface of said central area;

each said wrist strap and respective said surface to which each said wrist strap is attached defining a closed wrist passage, and each said shoulder strap and respective said surface to which each said shoulder strap is attached defining a closed shoulder passage;

at least one wrist strap reinforcement panel disposed between each said wrist strap and respective said wing tip area; and at least one shoulder strap reinforcement panel disposed between each said shoulder strap and said central area.

11. The attachment means according to claim 10, wherein each said strap comprises an elastic band.

12. The attachment means according to claim 10, including a fabric sleeve surrounding each said strap.

13. The winged costume and attachments according to claim 10, wherein said at least one shoulder strap reinforcement panel comprises an extension panel secured to said central area of said wing panel, and extending outwardly therefrom.

14. The winged costume and attachments according to claim 10, wherein said wing panel is formed of materials selected from the group consisting of natural and synthetic lightweight woven fabric materials.

15. The winged costume and attachments according to claim 10, wherein said wing panel is formed of a lightweight sheet of nonwoven material.

* * * * *